US005983975A

United States Patent [19]

Nilsson

[11] Patent Number: 5,983,975

[45] Date of Patent: Nov. 16, 1999

[54] METHOD OF DIE CASTING

[75] Inventor: Lars Nilsson, Torslanda, Sweden

[73] Assignee: AB Volvo, Gothenburg, Sweden

[21] Appl. No.: 08/117,017

[22] PCT Filed: Mar. 2, 1992

[86] PCT No.: PCT/SE92/00127

§ 371 Date: Oct. 20, 1993

§ 102(e) Date: Oct. 20, 1993

[87] PCT Pub. No.: WO92/15415

PCT Pub. Date: Sep. 17, 1992

[30] Foreign Application Priority Data

Mar. 5, 1991 [SE] Sweden ..... 9100644-5

[51] Int. Cl.[6] ..... B22D 19/08

[52] U.S. Cl. ..... 164/98; 164/112

[58] Field of Search ..... 164/98, 112, 332, 164/333, 334

[56] References Cited

U.S. PATENT DOCUMENTS 4,738,298 4/1988 Taruno et al. ..... 164/97

FOREIGN PATENT DOCUMENTS

| | | | |
|---|---|---|---|
| 0075052 | 3/1983 | European Pat. Off. . | |
| 666344 | 9/1938 | Germany | 164/112 |
| 58-38654 | 3/1983 | Japan . | |
| 58-112649 | 7/1983 | Japan . | |
| 58-181464 | 10/1983 | Japan . | |
| 62-6761 | 1/1987 | Japan | 164/97 |
| 165299 | 11/1958 | Sweden | 164/112 |
| 2168631 | 6/1986 | United Kingdom . | |

*Primary Examiner*—Kuang Y. Lin
*Attorney, Agent, or Firm*—Young & Thompson

[57] ABSTRACT

A method of die casting a cylinder block of aluminum wherein cylinder liners of another material are cast in. A cylinder insert component (14) is placed in the liner, leaving a gap (a) between the outer surface of the insert component and the inner surface of the liner. Pressurized aluminum melt flows against the outside of the liner and is allowed to flow into the gap via a passage (22) between the lower edge of the liner and a lower insert component (15), so that there will be the same pressure on the outside and inside of the liner. The aluminum inside the liner is then machined away.

4 Claims, 2 Drawing Sheets

METHOD OF DIE CASTING

FIELD OF THE INVENTION

The present invention relates to a die casting method for casting, in an object, a cylindrical liner in a cylindrical opening in the object, whereby a casting die insert component is placed inside the cylindrical liner, and a metal melt is pressurized against the outside of the liner. The invention is particularly but not exclusively directed to a method of die casting a cylinder block of aluminum in which cylinder liners of another material, such as cast iron or sintered metal, are cast in the cylinder openings.

BACKGROUND OF THE INVENTION

Today's aluminum engines of aluminum with cast-in cylinder liners are manufactured by die casting, which means that the aluminum melt is pressurized during the injection and hardening stages. In order to prevent the melt from penetrating into the cylinder liners, upper casting die insert components in the form of cylindrical bodies are used, which fill the liner, as well as lower casting die insert components, which abut the lower edges of the liners and the upper insert components, filling what is to become the cylinder block crank case.

The upper casting die insert is dimensioned so that a gap of about 0.2 mm is formed between the liner and the insert component when the liner is cold. This gap increases by about 0.5 mm to a total of about 0.7 mm upon heating to about 500° C. upon contact with the melt. The pressure in the melt subjects the liners, however, to great pressure from the outside, and the liners are deformed so much that they come into contact with the insert component. The result is that the liners are subjected to great stresses during the casting process. These stresses are not desirable since they can give rise to out-of-roundness at a subsequent stage of the manufacturing process, and this in turn can require extra machining of the liners themselves.

OBJECT OF THE INVENTION

The purpose of the present invention is to develop the die casting method described above by way of introduction so that the risk of out-of-roundness due to stresses in the liners can be completely eliminated.

SUMMARY OF THE INVENTION

This is achieved according to the invention by virtue of the fact that a casting die insert component is used which leaves a gap between itself and the liner, and that the pressurized melt is allowed to penetrate into the gap to create equal pressure from the pressurized melt on both sides of the liner.

The invention minimizes in the casting stage external stresses on the liner, and this results in the liner being rounder after casting than is the case when previously known die casting methods are used. Shrink stresses which arise later are required to keep the liner in place and for heat transfer when the engine is running.

BRIEF DESCRIPTION OF THE DRAWINGS

The invention will be described in more detail with reference to an example shown in the accompanying drawings, wherein.

DETAILED DESCRIPTION OF THE PREFERRED EMBODIMENT

Figure 2:
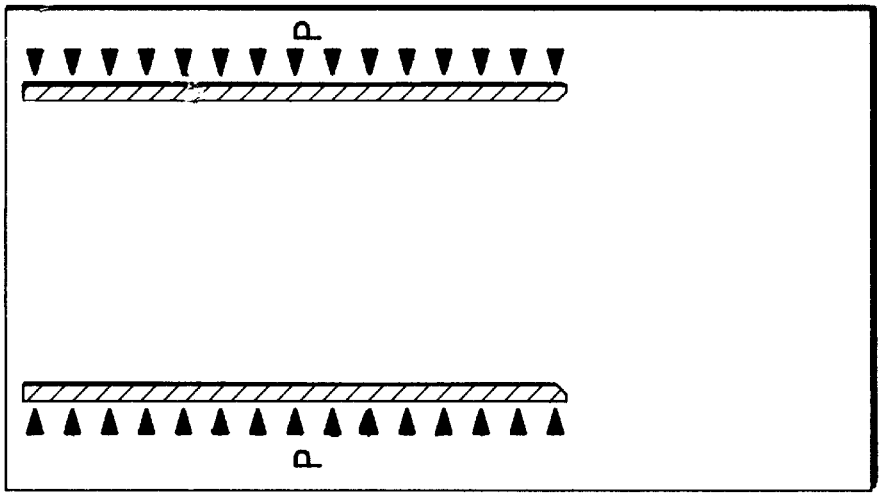
FIG. 2 PRIOR ART
FIG. 2 shows schematically the pressure load on the liner in the known die casting methods.
Figure 1:
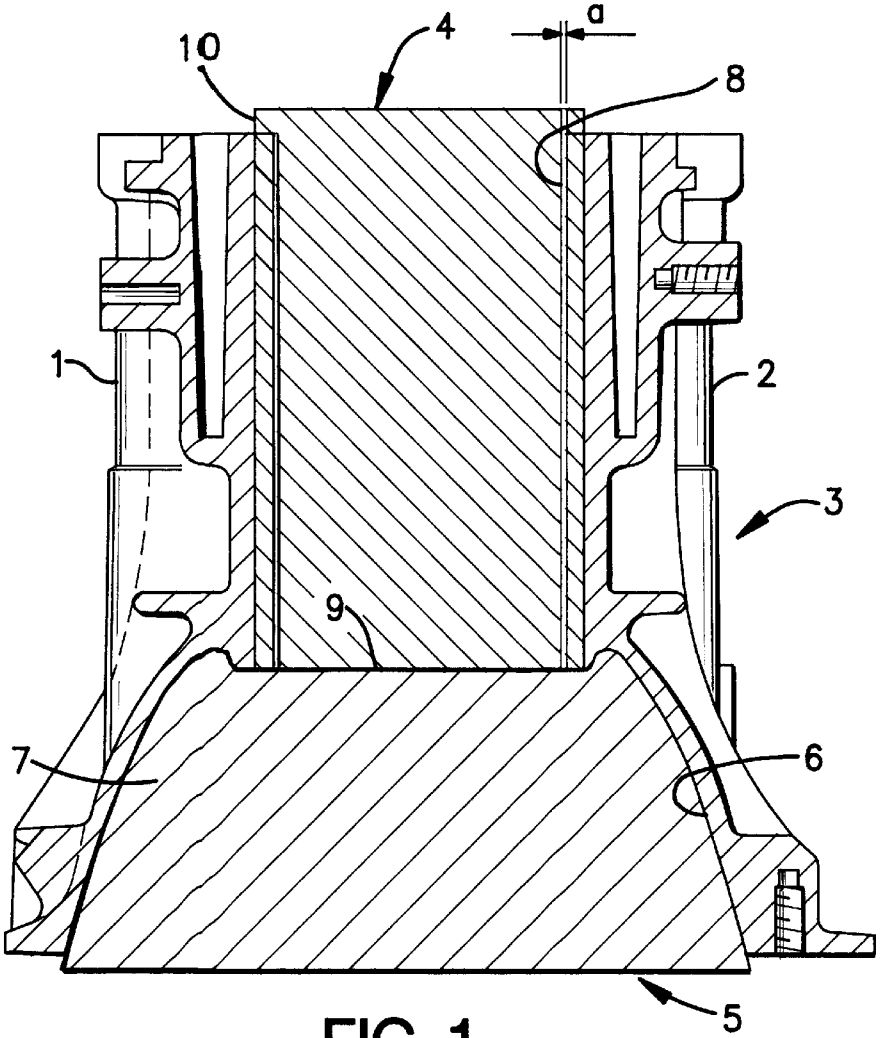
FIG. 1 PRIOR ART
FIG. 1 shows a cross section through a cylinder block with upper and lower casting die insert components, which are used in previously known die casting methods.

In FIG. 1, 1 and 2 designate opposite sides of a die cast aluminum blank for a cylinder block 3 after the pressurized melt has hardened and after the die components (not shown) in contact with the sides 1 and 2 have been removed, but before the upper and lower insert components 4 and 5 of the die have been removed. The upper insert component 4 of the die is a cylindrical body for each cylinder in the cylinder block, while the lower insert component 5 is a body 7 conforming to the shape of the crank case 6. The diameter of the cylinder 4 is so adapted to the inner diameter of a cylinder liner 8 that, when the liner is cold, there is a gap "a" of about 0.2 mm between the external surface of the cylindrical insert component 4 and the interior surface of the liner 8. When the liner is heated upon contact with the melt, the gap widens to about 0.7 mm.

As is evident from FIG. 1, the lower edge of the liner 8 is in direct contact with an upper surface 9 of the insert component 5, and this means that no melt can flow into the gap "a" from below. The upper insert component 4 is made with a flange portion 10 in contact with the upper edge of the liner, said flange portion preventing the melt from flowing from above into the gap "a". The result is that there will be a pressure difference between the inside and outside of the liner as illustrated in FIG. 2, and this in turn results in plastic deformation of the liner.

Figure 3:
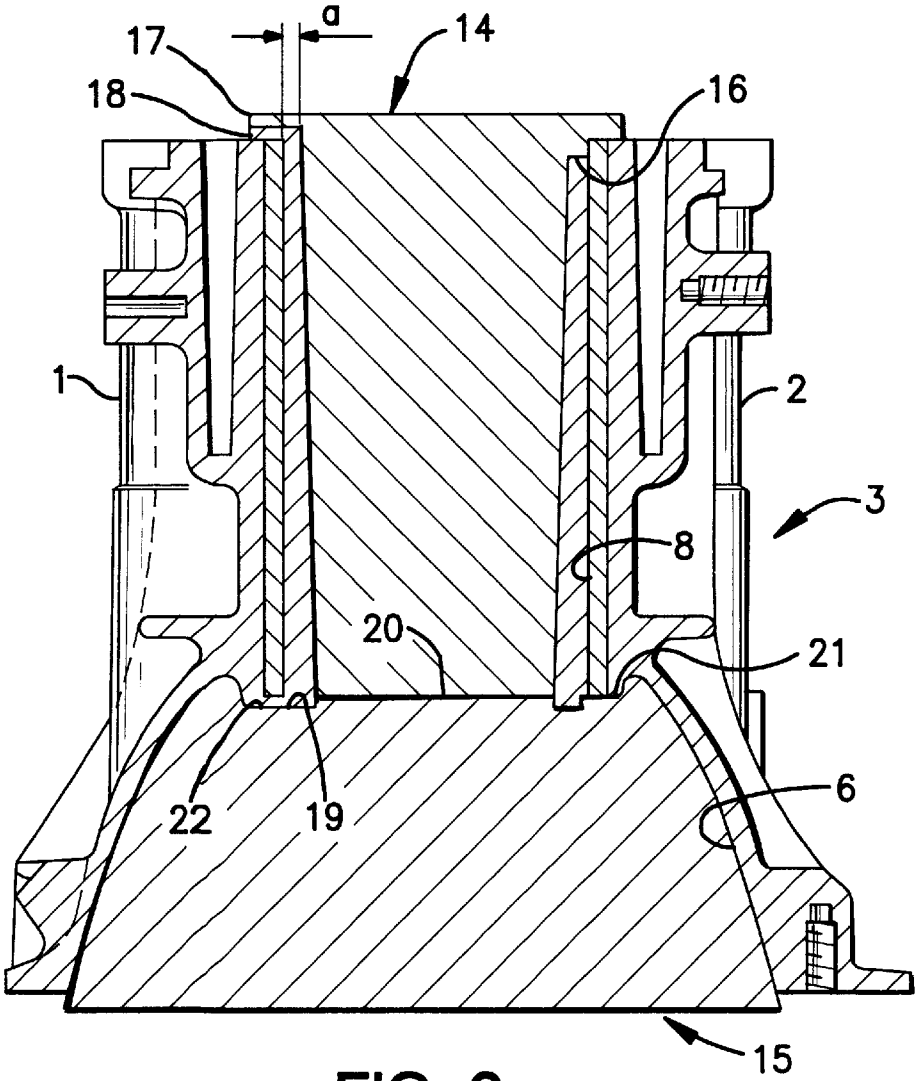
FIG. 3 shows a cross section corresponding to FIG. 1 with upper and lower casting die insert components, which are used in the die casting method according to the invention.

FIG. 3 shows the cylinder block 3 in a corresponding manner, but with somewhat modified upper and lower insert components 14 and 15, respectively, which are used in carrying out the method according to the present invention. Insert component 4 is slightly conical to obtain a draft angle of about 2° relative to the inside of the liner 8, and is so dimensioned that a gap "a" of between 5 mm and 10 mm is obtained between the outside of the insert component 14 and the inside of the liner 8. The insert component 14 is provided on its outside with at least three peripherally spaced guide heels 16 (one shown) for centering in the cylindrical opening in the liner 8, and it has an upper flange 17 lying above the upper edge of the liner 8 so that an annular gap 18, interrupted by the guide heels 16 is formed. The lower insert component 15 has an annular depression 19 in the supporting surface for the upper insert component 14. In the depression 19 there are at least three peripherally spaced supporting heels 21 (one shown) which support the lower edge of the liner 8. This design provides a lower passage 22, interrupted by the supporting heels 21, between the lower edge of the liner 8 and the upper surface of the lower insert component 15. As an alternative to the guide heels 16, axial ribs (not shown) can be used which extend along a certain portion of or the entire axial length of the insert component 14. The ribs can become downwardly narrower.

Figure 4:
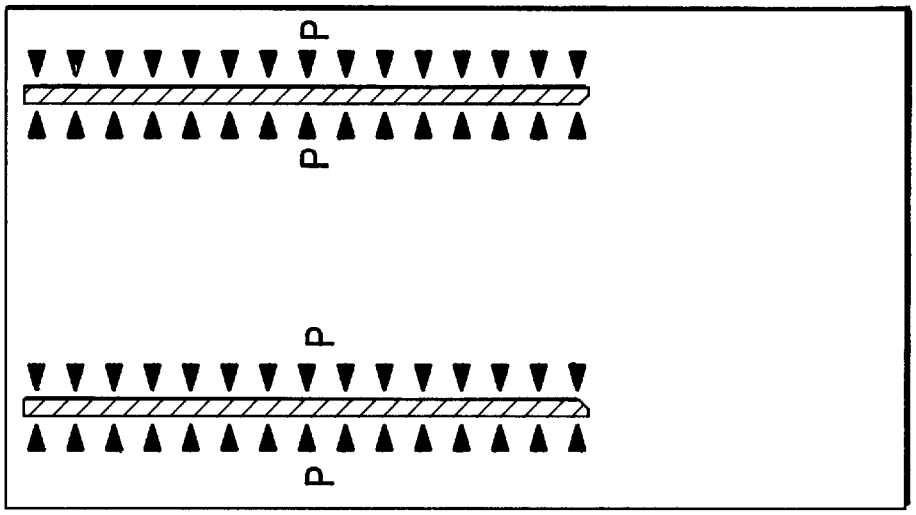
FIG. 4 is a schematic illustration corresponding to FIG. 2 of the die casting method according to the invention.

The embodiment described of the upper and lower insert components 14 and 15 means that the melt under pressure, which is injected between the outsides of the liners 8 and the insides of the die components not shown, can flow through the gap 22 between the lower edge of each liner and the surface of the depression 19 and up into the gap "a" between the inside of the liners 8 and the insert component 14. The gap 18 thus serves as a venting channel to let out air which is forced out by the incoming melt. The result is that the pressure of the melt against the outside of the liner is balanced by the same pressure from the melt in the gap "a", as is illustrated in FIG. 4, and this leads to a minimal external stress on the liner. After the melt has hardened and the insert components 14 have been removed, the aluminum material on the insides of the liners is removed in a subsequent removal and machining operation.

I claim:

1. A die casting method for securing a cylindrical liner of a metal different from aluminum in a cylindrical opening in an aluminum engine block, comprising placing within the liner a casting die insert component which leaves a gap between itself and the liner, injecting molten aluminum around said liner and into said gap to cover both the inner and the outer surfaces of the liner with molten aluminum, thereby to create equal pressure from the molten metal on both sides of the liner, and then, after the molten aluminum has solidified, removing the aluminum from the inner surface of the liner wherein said line is cast iron or sintered metal.

2. A method as claimed in claim 1, further comprising placing a second casting die insert component under a lower edge of said liner with a surface of said second component spaced from said lower edge thereby to form a passage, and causing said molten metal to flow from said space through said passage and into said gap.

3. A die casting method for producing an engine block of a first metal material comprising aluminum, the method comprising positioning in an engine block mold a cylinder liner of a second metal material different from aluminum, placing within the liner a casting die insert component which leaves a gap between itself and the liner, injecting said first metal material in molten form around said liner and into said gap to cover both the inner and the outer surfaces of the liner with said first metal material, thereby to define a cylinder bore contacting the outer surface of the liner and thereby to create equal pressure from the molten metal on both sides of the liner, and then, after the first metal material has solidified, removing all the aluminum from the inner surface of the liner wherein said second metal material is cast iron or sintered metal.

4. The method as claimed in claim 3 further comprising placing a second casting die insert component under a lower edge of said liner with a surface of said second component spaced from said lower edge thereby to form a passage, and causing said molten metal to flow from said space through said passage and into said gap.

* * * * *